United States Patent [19]

Whitright

[11] Patent Number: 4,986,683

[45] Date of Patent: Jan. 22, 1991

[54] TUBULAR WRITING INSTRUMENT

[76] Inventor: Curt E. Whitright, 11257 Thwing Rd., Chardon, Ohio 44024

[21] Appl. No.: 451,600

[22] Filed: Dec. 18, 1989

[51] Int. Cl.[5] ..... B43K 7/00; B43K 29/12

[52] U.S. Cl. ..... 401/195; 401/88; 401/209; 401/131; D19/46; D19/42; 281/44; 211/69.1

[58] Field of Search ..... 401/49, 88, 209, 208, 401/195, 258; D19/45, 51, 42, 46; D7/300.2; 446/343, 374, 267; 211/69.1, 69.5; 281/44

[56] References Cited

U.S. PATENT DOCUMENTS

| | | | |
|---|---|---|---|
| D. 158,056 | 4/1950 | Dinhofer | D7/300.2 |
| D. 184,204 | 1/1959 | Allan | D19/46 |
| D. 262,176 | 12/1981 | Kamin | D7/300.2 |
| D. 283,516 | 4/1986 | Huang | D19/41 |
| 2,738,616 | 3/1956 | Windle | 446/267 |
| 3,176,431 | 4/1965 | Richardson | 446/486 |
| 3,804,538 | 4/1974 | Rosa | 401/209 |
| 3,918,708 | 11/1975 | Augusta | 446/243 |
| 4,016,982 | 4/1977 | Schreiber | 211/69.1 |
| 4,666,417 | 5/1987 | Hillman | 446/267 |
| 4,678,206 | 7/1987 | Leahan | 281/44 |
| 4,687,306 | 8/1987 | Lipson et al. | 351/51 |

*Primary Examiner*—Richard J. Johnson
*Attorney, Agent, or Firm*—Oldham & Oldham Co.

[57] ABSTRACT

A writing instrument comprised of a hollow tubing housing wherein the upper portions of the housing are bent into attractive pleasing shapes with ornamental accessories such as eyes attached to the housing. The overall effect is to suggest a living creature or critter. A second embodiment of the writing instrument uses a base formed of hollow tubing bent into shapes to complement the living creature suggested by the upper housing.

16 Claims, 2 Drawing Sheets

1
6
5
10
2

1
5
6
10
2

1
5
6
10
2

30
4
2
23
20
21
22
20

30
4
2
23
22
20
21

TUBULAR WRITING INSTRUMENT

FIELD OF THE INVENTION

The present invention relates to writing instruments. In addition, one embodiment of the present invention relates to a combination note pad holder and writing instrument.

BACKGROUND OF THE INVENTION

Various types of ornamental and utility writing instruments have been designed. Examples of ornamental writing instruments include Leahan, U.S. Pat. No. 4,678,206, which shows a combination note pad holder and writing instrument. Very common in the prior art are desk sets for holding note paper and writing instruments.

None of these prior devices suggests using non-opaque tubing containing decorative material for the writing instrument housing. The prior art also does not suggest using the writing instrument housing itself to hold the note pad.

SUMMARY OF THE INVENTION

One embodiment of the present invention uses a non-opaque hollow tubing housing to contain the writing instrument. The upper portion of the housing is formed into unique attractive shapes and contains colored material such as yarn or string. The upper portion of the housing can also have additional decorative features such as eyes. The overall effect of the shape, colored material and decoration is to suggest a living creature.

Another embodiment adds a base which holds the writing instrument upright when placed on a horizontal surface such as a desk. The base is hollow tubing formed into a shape such as feet or an animal's tail. The shape of the base is selected to complement the shape of the upper housing. For example, a writing instrument shaped to suggest a snake would use a base shaped like a coiled snake's tail.

A third embodiment uses the upper portion of the writing instrument, shaped into a two turn coil, to hold a notepad such as a 3M Corporation "Post-It" pad.

DETAILED DESCRIPTION OF THE INVENTION

Figure 1:
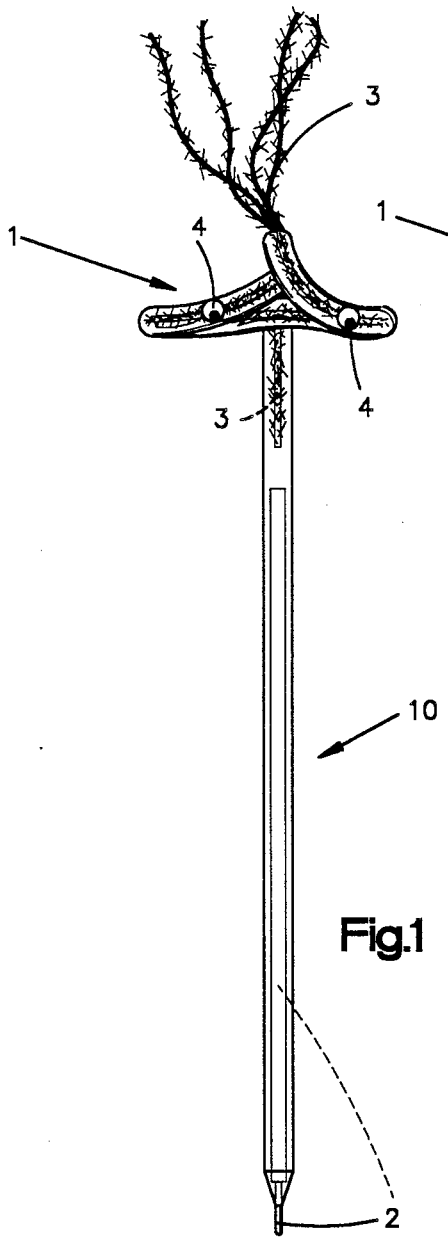
FIG. 1 shows a front view of the tubular writing instrument.

Referring to FIG. 1, the writing instrument 2 of the present invention is contained within a continuous hollow transparent tube or housing 10. The writing instrument 2 can be a ball point pen, a pencil, a felt tip pen or any other type of writing instrument that can be adapted to fit within a hollow tube 10. The writing instrument 2 is inserted into the housing 10 and retained in position by friction.

Figure 2:
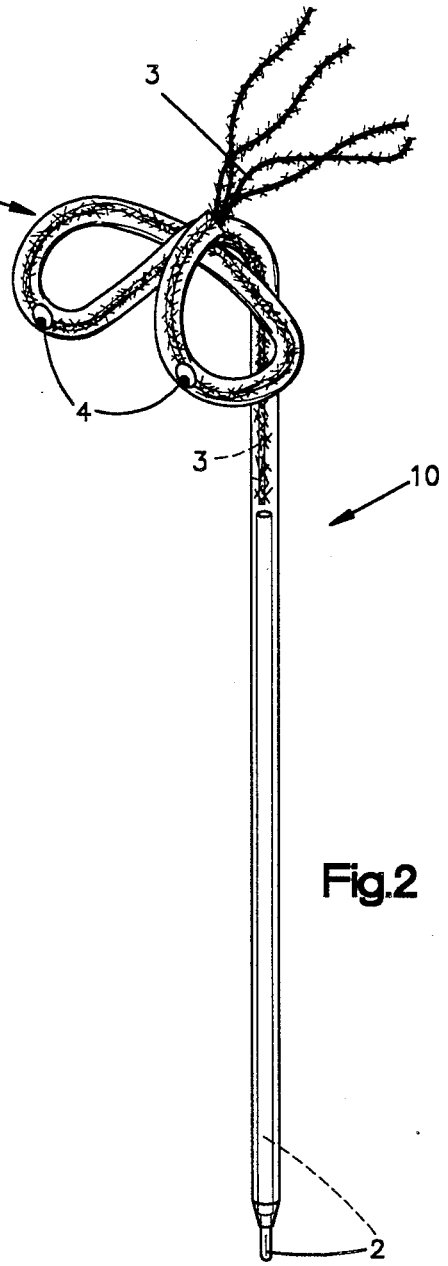
FIG. 2 shows a perspective view of the tubular writing instrument.

The upper portion 1 of the housing 10 may be filled with colored material 3 such as string or yarn. The colored material 3 may extend beyond the end of the housing 10 as shown in FIGS. 1 and 2, or it may extend only to the end of the housing 10. When the colored material 3 extends beyond the end of the housing 10, it may be tied, knotted or braided in any variety of pleasing designs.

The upper portion 1 of the housing 10 may be sealed at its upper end and just above the writing instrument 2 (seals not shown). Colored liquid may then be used in place of colored yarn or string 3.

The upper portion 1 of the housing 10 is shaped in curvilinear portions to form pleasing and attractive shapes. One of many possible shapes is shown in FIGS. 1 and 2. Another pleasing shape is shown in FIGS. 3 and 4.

The curvilinear portions of the housing 10 also have decorative features added such as eyes 4 as shown in FIG. 1. The overall effect of the curvilinear portions, the colored material within the upper portion 1 of the housing 10, and the decorative features 4 is to suggest a living creature or critter.

Figures 3, 4, 5, 6, 7:
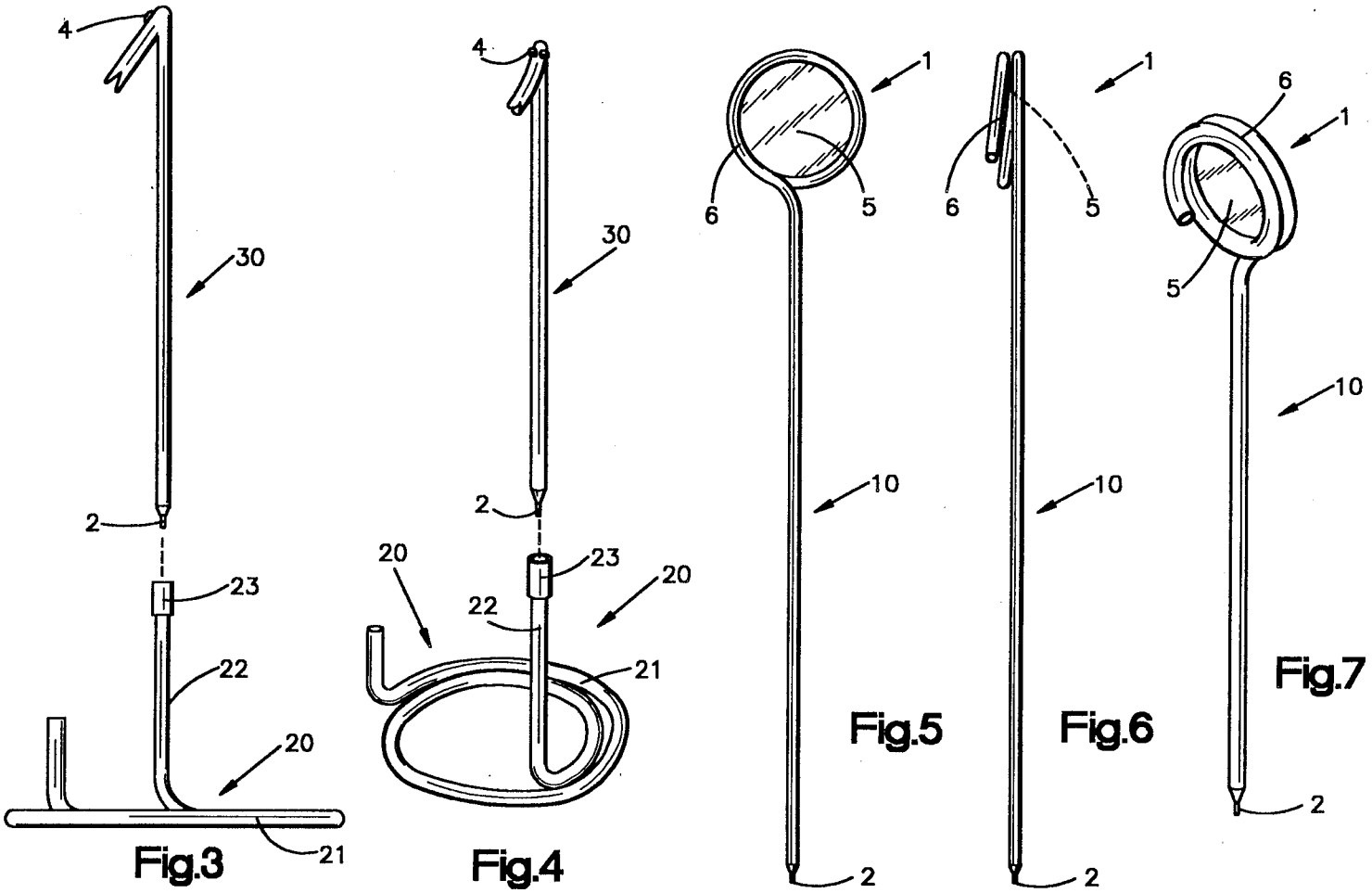
FIG. 3 shows a front view of the tubular writing instrument with a base for holding the writing instrument.
FIG. 4 shows a perspective view of the embodiment shown in FIG. 3.
FIG. 5 shows a front view of another embodiment of the tubular writing instrument in combination with a note pad.
FIG. 6 shows a side view of the embodiment shown in FIG. 5.
FIG. 7 shows a perspective view of the embodiment shown in FIG. 5.

Another embodiment of the tubular writing instrument is shown in FIGS. 3 and 4. This embodiment adds a base 20 to the basic invention described above.

The base 20 is formed from hollow tubing into a curved portion 21 and a vertical portion 22. The curved portion 21 forms a stable foundation to support the tubular writing instrument 30 in an upright position. A connector 23 is attached to the open end of the vertical portion 22. The tubular writing instrument 30 is inserted into the connector 23 when it is not being used.

The curved portion 21 of the base 20 is shaped to complement the overall shape of the tubular writing instrument 30. FIGS. 3 and 4 show a coiled snake's tail. A base 20 designed to complement the shape of the tubular writing instrument shown in FIG. 1 might be a pair of feet.

The tubular writing instrument 30 shown in FIGS. 3 and 4 uses opaque hollow tubing instead of the transparent tubing shown in FIGS. 1 and 2.

A third embodiment of the tubular writing instrument is shown in FIGS. 5 through 7. The upper portion 1 of the housing 10 is shaped into a two turn coil 6. Shapes other than a coil or spiral may be used as long as at least two turns are present. Shapes such a shamrock or a heart might be used.

The embodiment can be formed using transparent hollow tubing as shown in FIGS. 1 and 2 or opaque hollow tubing as shown in FIGS. 5 through 7. Colored material 3 can be inserted into either the transparent tubing or the opaque tubing.

A pad 5 of note sheets is inserted between the turns of the coil 6. The spacing between the turns of the coil 6 is small enough to hold the pad 5 in place. The pad 5 is normally the same shape as the coil 6. Note pads such as "Post-It" pads produced by the 3M Corporation can be used.

Other items can be inserted between the turns of the coil 6 in place of the pad 5. This could include a children's story book, a poem, a picture holder, an advertising logo. The items should be thin and essentially two dimensional.

I claim:

1. A writing instrument comprising:

a. a housing of generally transparent and substantially rigid hollow tubing wherein the upper portion of said housing is curvilinear and the lower portion of said housing is straight;

b. a writing instrument inserted into the lower end of said housing;

c. one or more lengths of flexible colored material inserted into the upper end of said housing, said colored material giving no appreciable support to said hollow tubing.

2. A writing instrument according claim 1 wherein ornamental accessories are fastened to the curvilinear portions of the upper portion of said housing.

3. A writing instrument according to claim 2 wherein said ornamental accessories resemble eyes.

4. A writing instrument according to claim 1 wherein said colored material comprises string.

5. A writing instrument according to claim 1 wherein said colored material comprises yarn.

6. A writing instrument according to claim 1 wherein said curvilinear portion of said upper housing comprising a plurality of essentially parallel loops.

7. A writing instrument according to claim 6 wherein a thin planar element is inserted between adjacent loops of said parallel loops, said planar element having an outer peripheral shape substantially identical to the peripheral shape of said parallel loops.

8. A writing instrument according to claim 7 wherein said planar element comprises a stack of a plurality of individual sheets of paper.

9. A writing instrument according to claim 1 wherein said instrument further comprises a base of hollow tubing comprising a horizontal section and a vertical section, said horizontal section being curvilinear and said vertical section having a retaining means located at its upper end, said curvilinear portion of said horizontal portion being shaped so as to retain said housing in a vertical position whenever said housing is inserted into said retaining means on said vertical section.

10. A writing instrument according to claim 1 wherein said flexible colored material extends beyond the upper end of said housing.

11. A writing instrument comprising:

a. a housing of substantially rigid hollow tubing wherein the upper portion of said housing is curvilinear and the lower portion of said housing is straight, said curvilinear portion having a plurality of essentially parallel loops, at least two said parallel loops oriented adjacent to one another;

b. a writing instrument inserted in the lower end of said housing; and c. a note pad comprised of a plurality of sheets of paper, said note pad having an outer peripheral shape substantially identical to peripheral shape of said curvilinear portions of said housing, wherein said note pad is inserted between adjacent loops of said parallel loops.

12. A writing instrument according to claim 11 wherein said hollow tubing is generally transparent and said flexible colored material is inserted into said hollow tubing.

13. A writing instrument according to claim 12 wherein said colored material comprises string.

14. A writing instrument according to claim 12 wherein said colored material comprises yarn.

15. A writing instrument according to claim 11 wherein said instrument further comprises a base of hollow tubing comprising a horizontal section and a vertical section, said horizontal section being curvilinear and said vertical section having a retaining means located at its upper end, said curvilinear portion of said horizontal section being shaped so as to retain said housing in a vertical position whenever said housing is inserted into said retaining means on said vertical section.

16. A writing instrument according to claim 12 wherein said flexible colored material extends beyond the upper end of said housing.

* * * * *